US005163166A

United States Patent [19]

Adler et al.

[11] Patent Number: 5,163,166

[45] Date of Patent: Nov. 10, 1992

[54] WARHEAD WITH ENHANCED FRAGMENTATION EFFECT

[75] Inventors: Wolf-Dieter Adler, Erftstadt; Wolfgang Böttger, Düsseldorf, both of Fed. Rep. of Germany

[73] Assignee: Dynamit Nobel Aktiengesellschaft, Troisdorf, Fed. Rep. of Germany

[21] Appl. No.: 596,010

[22] Filed: Oct. 11, 1990

[30] Foreign Application Priority Data

Oct. 11, 1989 [DE] Fed. Rep. of Germany ..... 3933954

[51] Int. Cl.[5] ..... F42B 12/32

[52] U.S. Cl. ..... 102/492; 102/494; 102/495; 102/489

[58] Field of Search ..... 102/491–497, 102/430, 473, 475, 476, 489, 490

[56] References Cited

U.S. PATENT DOCUMENTS 4,499,830 2/1985 Majerus et al. ..... 102/476

FOREIGN PATENT DOCUMENTS 0105495 4/1984 European Pat. Off. .
1364782 6/1972 United Kingdom .
1318966 5/1973 United Kingdom .

*Primary Examiner*—Michael J. Carone
*Attorney, Agent, or Firm*—Antonelli, Terry, Stout & Kraus

[57] ABSTRACT

Fragments, also in the shape of projectiles with a length to diameter ratio greater than 3, can be successfully accelerated directly by means of an explosive if at least one forward casing in the frontal zone of the fragment causes the shock wave generated by detonation of the explosive to pass from the fragment into the forward casing, which subsequently detaches from the fragment thus protecting the fragment from the destructive effects of the reflected shock wave.

14 Claims, 3 Drawing Sheets

WARHEAD WITH ENHANCED FRAGMENTATION EFFECT

BACKGROUND OF THE INVENTION

This invention relates to a method for the exposive acceleration of at least one preformed fragment (or projectile) wherein the shock wave front triggered upon ignition of the explosive is introduced from the rear (with respect to the desired flight direction of the fragment) or from the rear and the side into the fragment, as well as to a warhead wherein preformed fragments are in contact with or embedded in an explosive charge in such a way that, upon detonation of the explosive charge, each fragment can be directly accelerated, and to the use of the warhead for the explosive acceleration of such fragments or projectiles and to the use as an underwater fragmentation warhead. The direct explosive acceleration of one or several preformed fragments has been known e.g. from DE 2,821,723 C2. In this reference a shock wave front passes from the rear (with respect to the flight direction) out of the explosive charge into the fragments. During this transition the shock wave front is hardly attenuated and it travels through the full length of the fragment until it is finally reflected from the forward surface of the fragment back into the projectile. This process leads to an undesired plastic strain of the fragment and usually results in the destruction of the projectile: the forward section is torn off. The ballistics of the remaining pieces of the projectile are unpredictable thus degrading the use as a warhead especially for underwater applications. Failure of the material under the influence of reflected shock waves occurs particularly in fragments with a ratio of length to maximum diameter of more than 3. Therefore, all of the fragments known heretofore that can be directly accelerated by an explosive charge predominantly exhibit a spherical shape or are formed irregularly without any preferred direction. On the other hand, the range of the ballistic flight of the fragment, especially in water, strongly depends on its length to maximum diameter ratio; the range increases with this ratio.

SUMMARY OF THE INVENTION

It is an object of this invention to develop a method and to provide a device by means of which fragments can be explosively accelerated without severe plastic deformation or even disintegration of the fragment due to the reflected shock wave. In particular, the object resides in being able to directly accelerate and to impart a rotation-free flight to fragments having a ratio of length to maximum diameter of greater than 3, also called projectiles hereinbelow.

According to the method described here, this object has been attained by providing that the shock wave front is conducted further from the forward part of the fragment into a forward casing surrounding the forward section of the projectile. The material of the casing is chosen different from that of the projectile but in such a way that its mechanical impedance closely matches that of the projectile, preferably within a limit of 20%. In contrast to the material of the projectile the material of the forward casing must be highly ductile. Thus, when the shock wave reaches the front end of the projectile it travels into the casing material with almost no reflection due to the close impedance match while the casing material remains closely fitted to the front part of the projectile since it is highly ductile and therefore pressed against the projectile surface while the shock wave traverses the front part of the projectile.

The thickness of the foreward casing—measured in the direction of the shock wave propagation—is chosen in such a way that it can take up the full length of the shock wave until the latter one has decreased to a strength that does not lead to a major plastic deformation of the projectile. That is, the forward casing should have a thickness of at least 5 mm measured radially outward with respect to the longitudinal axis. The forward casing is shaped in such a way that it is torn away from the projectile surface as soon as the shock wave reaches the outer surface of the casing and imparts kinetic energy to the casing material. Therefore, as soon as the shock wave is reflected from the outer surface of the forward casing and it starts travelling back inward in the direction of the projectile, a gap has formed between the projectile material and the casing material, which prevents the shock wave from reentering the projectile again. In this way the projectile is protected from the destructive force of the shock wave. It is important that the projectile does not have a step-like profile in its forward portion in order to avoid reflections of the shock wave back into the material of the projectile and in order to provide a smooth transition of the shock wave into the casing material so that a maximum amount of energy of the shock wave is deduced into the casing material. The forward portion of the projectile, or preformed fragment, can have an ogival or conical shape; the casing material is combined with it e.g. by high precision machining, casting or diffusion bonding techniques. It is essential to combine both parts in such a way that gaps along the interface are avoided, while a firm connection is not required. It is advantageous to surround also a portion of the foreward (ogival or conical) part of the projectile beyond its maximum diameter with explosive because this laterally arranged explosive charge has a supporting effect in decoupling the shock wave from the projectile: the forward casing is urged especially tightly against the projectile surface by the detonation wave and therefore even during the transition phase of the shock wave a gap is avoided exactly during that time interval when the shock wave is to enter smoothly from the forward part of the projectile into the forward casing. However, acceleration of the projectile takes place in the propagation direction of the detonation front. Therefore the detonation of the explosive charge surrounding part of the forward portion of the projectile beyond its maximum diameter will interfere with the acceleration in the flight direction. The laterally located amount of explosive charge must therefore be optimized depending on the exact shape of the preformed fragment in order not to decelerate the projectile too much. Since the protective effect for the preformed fragment is achieved by producing a gap between the forward casing and the fragment front surface after the shock wave has passed through the fragment and the forward casing, the brisance of the explosive utilized for direct acceleration of the fragment is no longer limited to detonation velocities of about 1000 m/s. Detonation velocities can range up to e.g. 8000 m/s whereby a correspondingly high initial speed of the projectiles is achieved without disrupting the preformed fragments. An additional rearward casing can also contribute to increasing the efficacy of the acceleration process in the rear part of the preformed fragment. The rearward casing has to be shaped in such a way, that the detonation wave is refracted (as a shock wave) into the direction normal to the surface of the preformed fragment. Mechanical impedancies of the materials need not match in this region but the forward and rearward casing can readily be made of the same material, so that in the simplest case the preformed fragment is fully embedded in the casing material with no distinct separation of the rearward and forward parts of the casing. By means of the above described method and its use in the device of this invention it is possible to accelerate projectiles individually or in groups into predetermined directions with explosive charges and a considerable enhancement of efficiency is achieved as compared to known methods and devices particularly in underwater applications.

The warhead is characterized in that the forward portion of each fragment with respect to its flight direction has a forward casing detaching itself from the fragment after detonation of the explosive.

BRIEF DESCRIPTION OF DRAWINGS

The invention is illustrated in the accompanying drawings and will be described in greater detail hereinafter. In the drawings.

DETAILED DESCRIPTION OF THE PREFERRED EMBODIMENT

Figure 1:
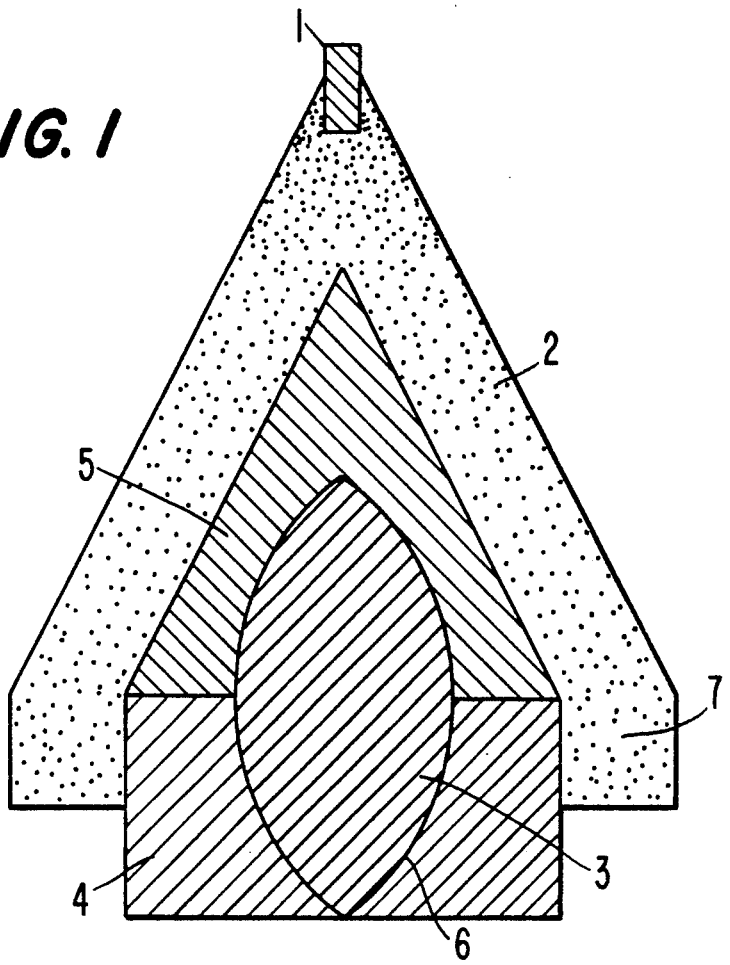
FIG. 1 is a schematic longitudinal sectional view through a projectile or preformed fragment surrounded by a casing and embedded in an explosive matrix.
Figure 2:
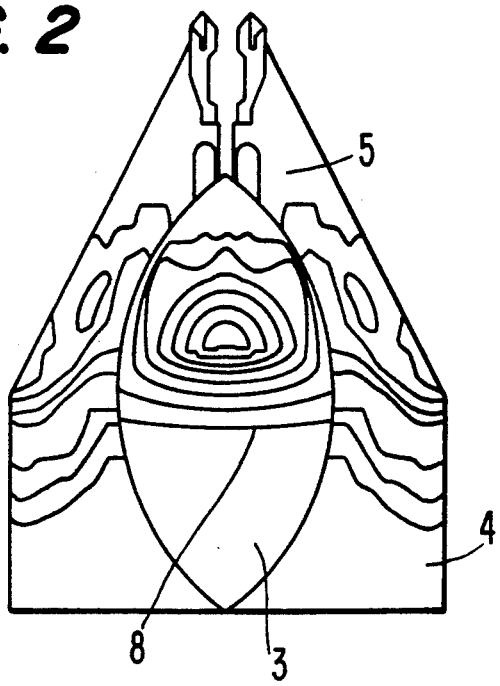
FIG. 2 shows calculated material boundaries and contour lines of the pressure distribution after the detonation wave has fully traversed the explosive charge and with the shock wave having gone approximately half way through the projectile.

Referring now to FIG. 1 the device has an explosive charge 2 as an outer layer, which can be initiated by the central detonator 1 and which essentially has a conical shape. After initiation of the explosive a detonation wave propagates downward accelerating the casing 4, 5 and the projectile 3 and creating shock waves in these solid materials. The flight direction in the figures therefore is downward. The shock wave front 8 in the projectile 3, or preformed fragment, is perpendicular to its longitudinal axis as can be seen in FIG. 2, where the pressure contour lines are shown at an instant right after the explosive is completely detonated. The explosive material is therefore no longer shown in FIG. 2.

The projectile 3 is surrounded by the casing parts 4, 5, which are made of a highly ductile material. The casing parts 4, 5 may be joined together with the explosive charge 2 e.g. by glueing. The casing parts consist in this embodiment of the same material but the parts 4 and 5 differ from each other with respect to their function. The rearward casing 5 has the task of enhancing the acceleration effect of the detonation wave by refracting it into the direction normal to the surface of the projectile 3. The forward casing 4 remains in close contact to the surface of the projectile 3 in order to take in the shock wave travelling through the projectile 3, which is achieved by choosing a material that closely matches the mechanical impedance of the material of the projectile 3. As soon as the shock wave front reaches the lower boundary of the casing material 4 a gap starts forming along the interface 6 between the forward part 4 of the casing and the surface of the projectile 3. The following nonlimitative example represents a typical choice of materials:

| | | |
|---|---|---|
| Explosive: RDX | | |
| Density: 1.82 g/cm$^3$ | Detonation velocity: | 8100 m/s |
| Casing material: Copper | | |
| Density: 8.9 g/cm$^3$ | Sound velocity: | 4700 m/s |
| Projectile material: Steel | | |
| Density: 7.85 g/cm$^3$ | Sound velocity: | 5920 m/s |

The mechanical impedances for steel and copper are 46.47 MPa sec/m and 41.83 MPa.sec/m. The reflectivity at the interface has a value of 0.5, i.e. the amplitude of the reflected wave is about 28 dB below that of the incoming shock wave. For practical applications this match of the impedances is close enough. Since the value of Young's modulus for copper is only slightly more than half of that for steel, copper is very ductile as compared to steel and can therefore be pressed against the body of the projectile without deforming it during the transition of the shock wave and it will be readyly torn away from the projectile once the shock wave is trapped inside the copper casing. Other choices for the casing material could be brass, zinc or lead, for the projectile tungsten or tantalum.

Figure 3:
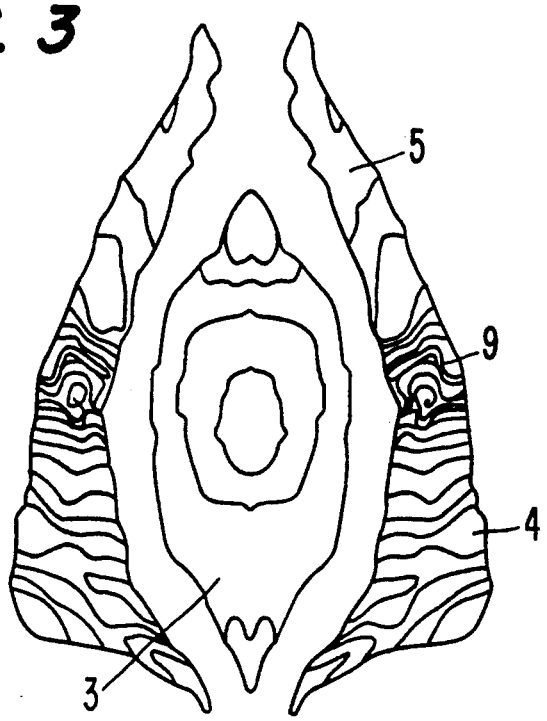
FIG. 3 shows calculated material boundaries and contour lines of the pressure distribution after the gap has developed.
Figure 4:
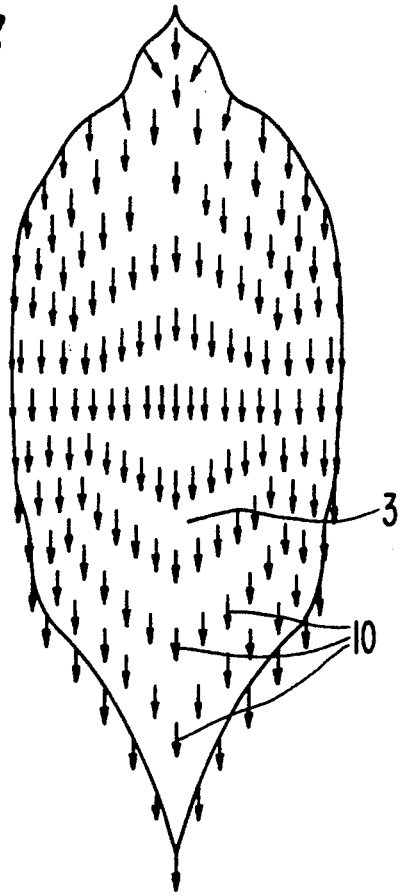
FIG. 4 shows the calculated resulting velocity distribution in the projectile after separation of the casing.
Figure 5:
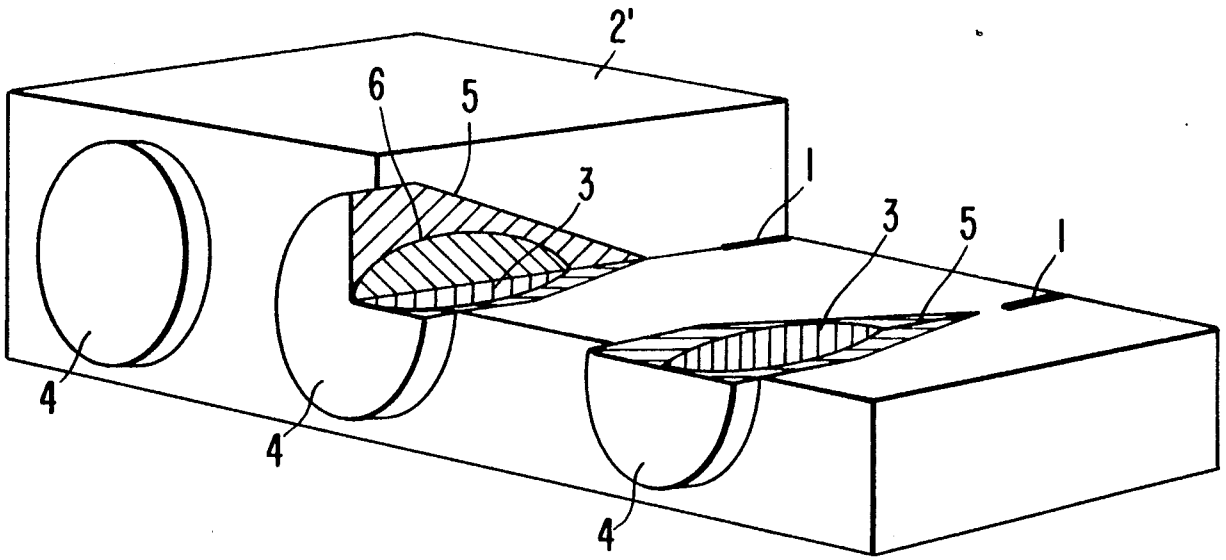
FIG. 5 shows a perspective view, partially in section, of an explosive charge having multiple fragments located within the explosive charge.

As FIG. 1 shows, the explosive charge 2 reaches with its forward annular part 7 beyond the maximum diameter of the projectile 3, i.e. it is laterally arranged around part of the forward section of the projectile 3. This part 7 of the explosive charge does not contribute to the acceleration of the projectile 3 but rather presses the forward casing 4 against the projectile 3 as the shock wave passes through that part of the casing 4. The beginning of this process can be seen in FIG. 2 where the inclination of the contour lines for the pressure in the forward casing 4 indicates, that the casing material is pressed towards the surface of the forward part of the projectile 3 thus providing good mechanical contact between the two materials to facilitate the transition of the shock wave from the projectile 3 into the casing material 4. In embodiments differing from the one described here the forward casing 4 may also extend beyond the forward end of the projectile 3 in order to provide an additional protective effect for the sensitive tip of the projectile. FIG. 3 shows the material boundaries and the pressure contour lines for an instant after the shock wave has passed into the casing material 4,5 and the casing material 4,5 is already detached from the projectile 3. The shock wave front 9 was reflected from the forward boundary of the casing material 4 and it is now propagating upward in the casing material 4,5. The casing material 4,5 will finally disintegrate under the influence of the plastic strain exerted by the shock wave. The remaining pressure distribution in the projectile 3 is in the order of magnitude that merely causes elastic deformation of the material, i.e. the projectile 3 will vibrate in a "breathing mode". After these vibrations have subsided the projectile 3 will not be distorted any more. This can be seen in the homogeneous velocity distribution in the projectile 3 as shown in FIG. 4. Velocity vectors 10 are equally long and parallel in the flight direction throughout the material of the projectile, therefore no deformation of the projectile shape takes place. The result is a projectile going at high speed in the direction predetermined by the longitudinal axis of the original device with the shape of the projectile essentially given by the shape of the elongated preformed fragment.

We claim:

1. A method for explosive acceleration of at least one preformed fragment wherein a shock wave front is introduced by a detonation wave triggered upon ignition of an explosive charge from the rear, with respect to the resulting flight direction of the fragment, or from the rear and the side into the fragment, characterized in that the shock wave front is further conducted from a forward zone of the fragment into a forward casing surrounding said forward zone of the fragment, that the casing material is chosen to closely match mechanical impedance of the fragment material, that the thickness of the forward casing is such that it can take up the full length of the shock wave, that the connection of the casing material with the fragment is such that the shock wave can enter the forward casing, but can travel back after being reflected from the surface of the forward casing into the fragment, if at all, only in a very weakened state.

2. A warhead with fragmentation effect wherein preformed fragments are in contact with or are inserted in an explosive charge so that upon detonation of the explosive charge, each fragment can be directly accelerated, characterized in that a forward portion of each fragment, with respect to the flight direction of the fragment, is provided with a forward casing which detaches itself from the fragment after detonation of the explosive charge and the cross section of the fragment surrounded by the forward casing decreases in a continuous fashion towards a forward end of the fragment.

3. A warhead according to claim 2, characterized in that a junction area of the forward casing with the forward part of the fragment is provided so that, based on a closely matching mechanical impedance, initially an extensively undisturbed passage of the shock waves caused by the detonation of the explosive is made possible, and the junction area between the fragment and the forward casing provides simultaneously an intentional breaking zone capable of forming a gap at the junction area.

4. A method according to claim 1, further characterized by forming the rearward casing so that the rearward casing acts as a wave shaper and an entering detonation wave is refracted towards the fragment surface.

5. A warhead according to claim 2, characterized in that a rear portion of the fragment is surrounded by a rearward casing.

6. A warhead according to claim 2, characterized in that an entire rear portion of each fragment is inserted in the explosive charge.

7. A warhead according to claim 6, characterized in that the explosive charge embedding the fragment extends beyond a location of the maximum diameter of the fragment.

8. A warhead according to claim 2, characterized in that the fragment has a ratio of length to maximum diameter of greater than 3.

9. A warhead according to claim 2, characterized in that the forward casing has a thickness of at least 5 mm measured radially outward with respect to the longitudinal axis.

10. A warhead according to claim 2, characterized in that the forward casing consists of a ductile material.

11. A warhead according to claim 10, characterized in that the forward casing is bonded to the fragment.

12. A warhead according to claim 2, characterized in that the rearward casing is formed so that the rearward casing acts as a wave shaper and an entering detonation wave is refracted towards the fragment surface.

13. A warhead according to claim 2, wherein the fragments are shaped as projectiles.

14. A warhead according to claim 2, wherein the warhead comprises an underwater fragmentation warhead.

* * * * *